US008474470B2

(12) United States Patent
Albertyn

(10) Patent No.: US 8,474,470 B2
(45) Date of Patent: Jul. 2, 2013

(54) CRUTCH

(76) Inventor: Colin Patrick Albertyn, Roodepoort (ZA)

( * ) Notice: Subject to any disclaimer, the term of this patent is extended or adjusted under 35 U.S.C. 154(b) by 104 days.

(21) Appl. No.: 13/055,444

(22) PCT Filed: Aug. 5, 2009

(86) PCT No.: PCT/ZA2009/000070

§ 371 (c)(1),
(2), (4) Date: Jan. 21, 2011

(87) PCT Pub. No.: WO2010/017566

PCT Pub. Date: Feb. 11, 2010

(65) Prior Publication Data

US 2011/0126872 A1 Jun. 2, 2011

(30) Foreign Application Priority Data

Aug. 6, 2008 (ZA) ..... 2008/6795

(51) Int. Cl.
*A61H 3/02* (2006.01)

(52) U.S. Cl.
USPC ..... 135/71; 135/69; 135/74; 403/107; 602/20; 482/67

(58) Field of Classification Search
USPC ..... 135/65, 68, 71–73, 76, 82, 86; 602/16, 602/20, 27, 62, 65; 482/112, 115, 117, 118, 482/67–68, 75; 248/118–118.3, 288.11; 403/107, 111–112, 321, 324; 297/411.1, 297/411.2, 411.38
See application file for complete search history.

(56) References Cited

U.S. PATENT DOCUMENTS 2,409,365 A * 10/1946 Lamb ..... 135/71
2,771,089 A 11/1956 Magida
2,857,925 A * 10/1958 Higginbotham ..... 135/86
4,141,375 A * 2/1979 Tykwinski ..... 135/66

(Continued)

FOREIGN PATENT DOCUMENTS

DE 2 310 986 9/1974
DE 299 07 993 U1 9/1999

(Continued)

OTHER PUBLICATIONS

International Search Report; Application No. PCT/ZA2009/000070; Filed Aug. 05, 2009.

*Primary Examiner* — Winnie Yip
(74) *Attorney, Agent, or Firm* — Knobbe, Martens, Olson & Bear, LLP

(57) ABSTRACT

The invention provides a forearm type of crutch comprising an operatively upright staff having a ground engaging foot at one end and a transverse handle and forearm support assembly at the operatively upper end, and wherein the angle of inclination of the forearm support assembly to the staff is adjustable, wherein the angle of inclination of the forearm support assembly relative to the staff is adjustable by means of a pair of co-operating positioning portions, one being stationary relative to the staff and the other being stationary relative to the forearm support assembly and wherein the positioning portions have complementarily co-operating zones that are engagable in different angular positions of the forearm support assembly and staff to provide a desired angle of inclination of the forearm support assembly relative to the staff and wherein releasable clamping means operatively hold the positioning portions in a selected engaged position for use.

24 Claims, 5 Drawing Sheets

U.S. PATENT DOCUMENTS

| | | | | |
|---|---|---|---|---|
| D258,096 | S * | 2/1981 | Barfod | D3/8 |
| 4,248,256 | A * | 2/1981 | Thomas | 135/67 |
| 5,212,900 | A * | 5/1993 | Perry | 43/21.2 |
| 5,329,954 | A | 7/1994 | Miyoshi | |
| 5,671,765 | A * | 9/1997 | Hagberg, Jr. | 135/68 |
| 6,295,755 | B1 * | 10/2001 | Macaluso | 43/25 |
| 7,111,856 | B1 * | 9/2006 | Graham | 280/87.021 |
| 7,712,479 | B2 * | 5/2010 | Sundarrao | 135/74 |
| 2008/0053503 | A1 | 3/2008 | Larson et al. | |
| 2009/0235966 | A1 * | 9/2009 | Birnbaum | 135/66 |

FOREIGN PATENT DOCUMENTS

| | | | |
|---|---|---|---|
| JP | 2008086610 | A * | 4/2008 |
| WO | WO 2005041844 | A1 * | 5/2005 |
| WO | WO 2007/094769 | | 8/2007 |

* cited by examiner

Figure 8
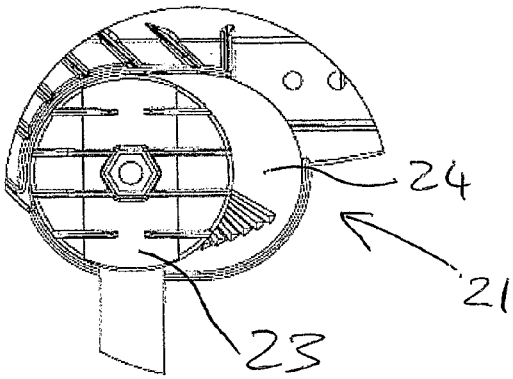
Figure 10
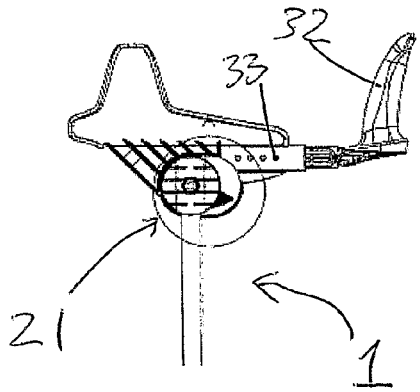
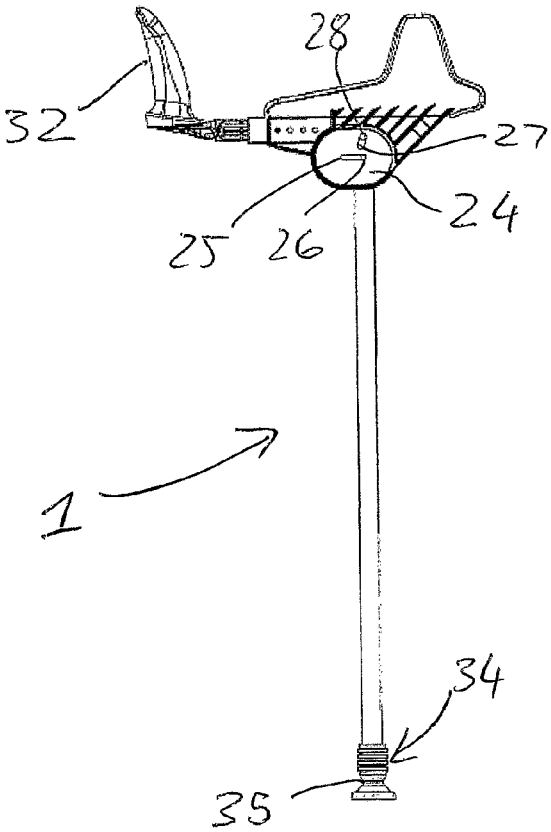
Figure 9

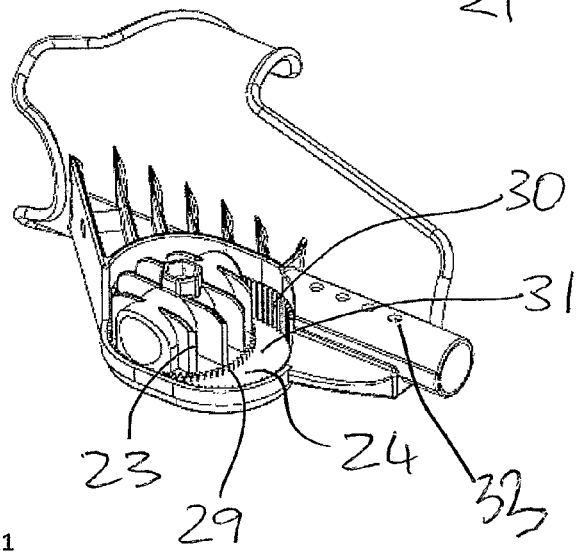
Figure 11
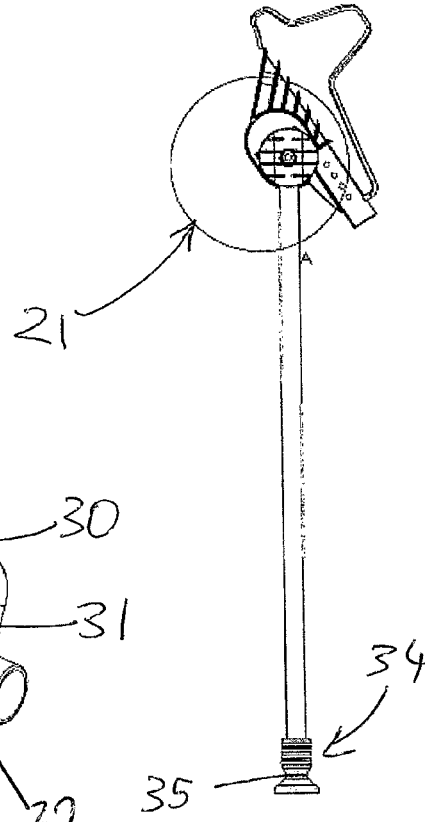
Figure 12
Figure 13
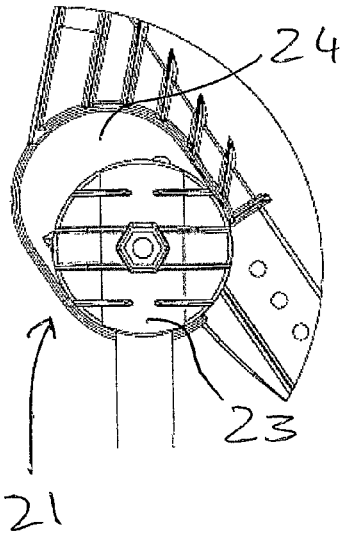

CRUTCH

FIELD OF THE INVENTION

This invention relates to a crutch of the type used by a lame or infirm person typically suffering from some sort of temporary or permanent disability of the legs to assist such person in standing or walking. It is to be understood that the term disability is used to include any condition that would be alleviated by the use of a crutch in order to partially support the person's weight as and when required.

BACKGROUND OF THE INVENTION

Traditional crutches invariably have a staff (sometimes referred to as a stick or cane) or a composite staff assembly with an upper transverse support for engagement in a person's armpit and a handle between the upper support and a foot at the operatively lower end of the crutch. Whilst still enjoying wide use in many instances, such traditional crutches have been replaced in more recent times, at least to some extent, by lightweight forearm crutches that have an inclined forearm support at the operatively upper end of a staff with which a user's wrist and forearm can be engaged in order to provide added stability and control and a handle at a free end of the forearm support. Such crutches, in instances in which their use is appropriate, are less cumbersome than the traditional crutch that is outlined above. are less tiring to use; and provide for added maneuverability.

Nevertheless, the forearm crutches that are presently available cannot, as far as applicant is concerned, be adequately adjusted for individual requirements; they may impart unnecessary strain on the wrist or hands of a user; and appear to be limited in application due to limited support afforded by them.

U.S. Pat. No. 5,671,765 to Hagberg Jr describes one form of forearm crutch that has some desirable properties including the feature of the position and angle of the joint between the forearm support assembly and the supporting ground engaging staff being selected from a plurality of different possibilities. However, the selection of any particular possibility is achieved utilizing a series of different combinations of aligned holes to provide different angles of inclination of the forearm support assembly relative to the staff and positions of attachment to the staff. It is applicant's view that the adjustment provided by this prior art patent is totally inadequate to take into account the wide variety of different requirements of different individuals.

OBJECT OF THE INVENTION

It is an object of this invention to provide a forearm type of crutch in which adjustability is more effectively provided so that individual requirements can be more easily met.

SUMMARY OF THE INVENTION

In accordance with this invention there is provided a forearm type of crutch comprising an operatively upright staff having a ground engaging foot at one end and a transverse handle and forearm support assembly at the operatively upper end, and wherein the angle of inclination of the forearm support assembly to the staff is adjustable, wherein the angle of inclination of the forearm support assembly relative to the staff is adjustable by means of a pair of co-operating positioning portions, one being stationary relative to the staff and the other being stationary relative to the forearm support assembly and wherein the positioning portions have complementarily co-operating zones that are engagable in different angular positions of the forearm support assembly and staff to provide a desired angle of inclination of the forearm support assembly relative to the staff and wherein releasable clamping means operatively hold the positioning portions in a selected engaged position for use.

The complementarily co-operating zones may be in the form of a frictionally engaging material, similar to sand paper or a clutch plate.

The positioning portions may be a pair of co-operating indexing portions, one being stationary relative to the staff and the other being stationary relative to the forearm support assembly and wherein the indexing portions have as the complementarily co-operating zones multiple angularly spaced co-operating formations that are engagable in multiple different angular positions of the forearm support assembly and staff to provide a selection from multiple different angles of inclination of the forearm support assembly relative to the staff and wherein releasable clamping means operatively hold the indexing discs in a selected inter-engaged position for use.

The angularly spaced co-operating formations may be gear teeth located on an outer periphery of one of the indexing portions and complementary gear teeth on an inner peripheral portion of the other indexing portion, wherein the indexing portion with gear teeth on its outer periphery is sized and dimensioned to fit snugly within a recess of the indexing portion with gear teeth on an inner peripheral portion whereby the gears mesh to hold the indexing disks in a selected inter-engaged position for use.

The multiple angularly spaced formations may be angularly spaced formations on the face of each of the disks. The formations may be equally spaced.

The angularly spaced formations on each of the indexing discs may be in the form of a series of said formations extending around an arc of 360 degrees.

The formations may be in the form of radially extending tooth formations.

The formations may be of triangular shape in cross-section with the width of the base of the triangle increasing from a radially inner end of a tooth to a radially outer end thereof.

The indexing disc associated with the staff may be formed integral with a plastics injection moulded socket receiving the operatively upper end of the staff.

The indexing disc associated with the forearm support assembly may be formed integral with a central body part of the forearm support assembly.

The releasable clamping means may be a screw threaded fastener comprising a nut held non-rotatably relative to one of the indexing discs and a screw threaded shank held non-rotatably relative to a manually operable head for rotating the screw threaded shank.

The indexing discs may be round, oval, or another suitable shape.

In order to allow for lateral, rather than angular, adjustment of the position of the staff relative to the forearm support, the pair of co-operating positioning portions is provided with an elongate slot and pin arrangement, whereby the portions are slidably displaceable relative to each other within the restraints posed by the pin in the slot.

The pair of co-operating portions may be provided with a second slot and pin arrangement to further restrain the relative displacement of the portions.

The second slot may be sized and dimensioned complementarily to the size and dimension of the pin thereby to snugly receive the pin and thus the slot may have an inner diameter only slightly larger than the outer diameter of the pin.

The second slot may be elongate.

One of the pair of the co-operating portions may be a circular indexing disk and the other may be an oval recess indexing portion in which the circular indexing disk is displaceable and lockable in a desired position.

Stop means may be provided to limit the extent of relative displacement, either angularly or laterally, of the indexing disks.

Still further features of the invention provide for the forearm support to have a transverse handle at one end thereof with the support extending operatively rearwards to an elbow supporting zone at its opposite end.

The transverse handle may be like a joystick of a gaming apparatus which is anatomically sized and dimensioned for a comfortable and stable grip by a user.

The orientation of the transverse handle may be adjustable relative to the forearm support.

The transverse handle length may be adjustable.

The distance of the handle from the elbow supporting zone may be adjustable.

Said opposite end may have an angularly adjustable stabilizer for engaging the upper arm in the region above the elbow.

The length of the staff may be adjustable.

The foot may be a resiliently deformable foot exhibiting shock absorbing characteristics.

The foot may be bendable in a mid-zone thereof so that a ground engaging portion of the foot remains in contact with the surface on which it is used even if the incident angle of the staff to the surface is acute.

It is a particular feature of the invention that the surface of the forearm support engaged by a forearm in use be provided with friction affording padding or lining that is particularly adapted to deform to the shape of a user's forearm to thereby spread the force on the forearm and accept some of the weight of the person by way of frictional forces between the forearm and padding or lining on the forearm support.

In order that the above and other features of the invention may be more fully understood one embodiment of the invention and a variation thereof will now be described with reference to the accompanying drawings.

BRIEF DESCRIPTION OF THE DRAWINGS

In the drawings:—

FIG. 8 is a second embodiment of an adjustment arrangement of the crutch of the invention;

FIG. 9 is a side view of a crutch having the adjusting arrangement of FIG. 8;

FIG. 10 is a opposite side view of the crutch of the FIG. 9, in which the adjustment arrangement of FIG. 8 is indicated as "A";

FIG. 11 is a third embodiment of an adjustment arrangement of the crutch of the invention;

FIG. 12 is a crutch including the third embodiment of the adjustment arrangement; and FIG. 13 is detail A of the crutch of FIG. 12.

DETAILED DESCRIPTION WITH REFERENCE TO THE DRAWINGS

Figure 1:
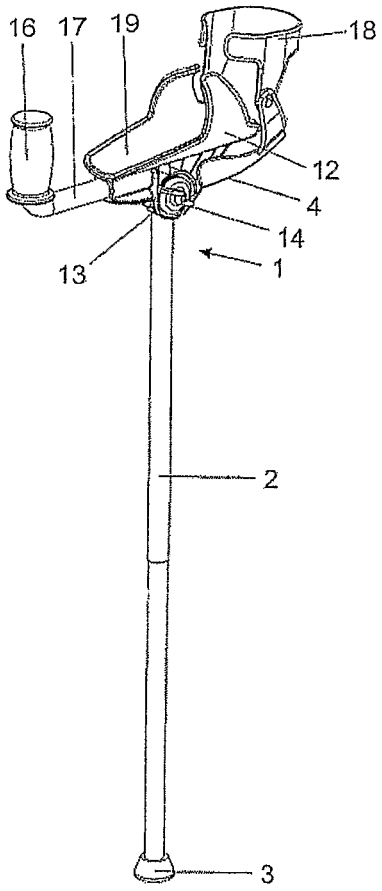
FIG. 1 is a perspective illustration of one embodiment of crutch according to the invention with the forearm support in a generally horizontal position.
Figure 2:
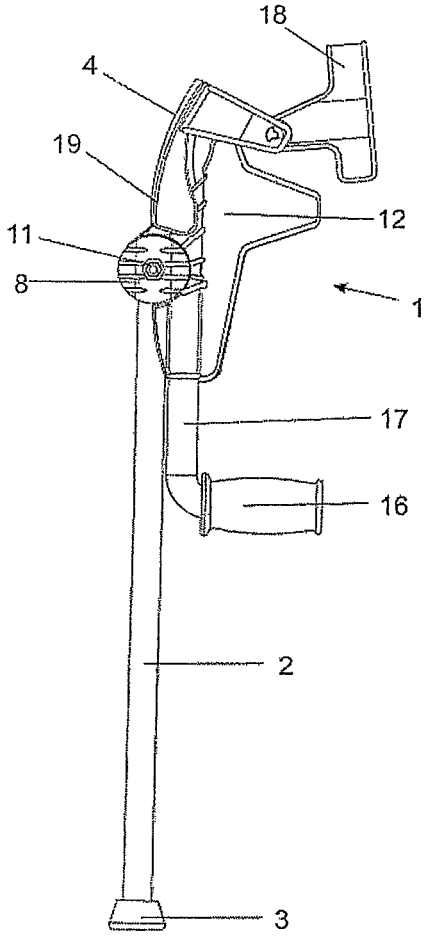
FIG. 2 is a side view thereof with the forearm support in a generally vertical position.
Figure 3:
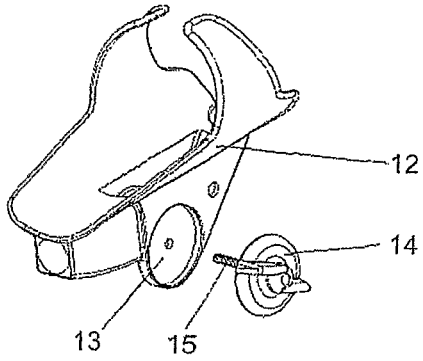
FIG. 3 is an exploded perspective view of the central body of the forearm support from one side thereof.

In the embodiment of the invention illustrated generally in FIGS. 1 and 2 of the drawings, a forearm crutch, generally indicated by numeral (1), has a staff (2) that may be telescopically adjustable in length in any suitable manner. The lower end of the staff may have a shock absorbing resilient foot (3) attached to it that may be interchangeable with a multi-foot base having, say, three feet for the purpose of guiding the staff to an upright position.

The operatively upper end of the staff carries a forearm support assembly (4) wherein the angle of inclination of the forearm support assembly to the staff is adjustable. Adjustability is, in this embodiment of the invention, achieved utilizing a pair of co-operating indexing discs (5, 6) of which one (5) is stationary relative to the staff and the other (6) is stationary relative to the forearm support assembly.

Each indexing disc has multiple equally angularly spaced co-operating formations in the form of radially extending tooth formations (7) of substantially exactly complementary shape so that the tooth formations on one indexing disc are snugly received in the space between two adjacent tooth formations of the other indexing disc when the two are axially aligned and engaged one with the other.

The tooth formations are conveniently of triangular shape in cross-section with the width of the base of the triangle increasing from a radially inner end of a tooth to a radially outer end thereof. In this embodiment of the invention the multiple tooth formations form an annular series, in each case, extending around 360 degrees on the face of the disc and adjacent tooth formations are angularly offset from each other by an angle of 7.5 degrees. Such an arrangement provides for 12 different angular inclinations of the forearm support assembly relative to the staff.

Figures 5, 6:
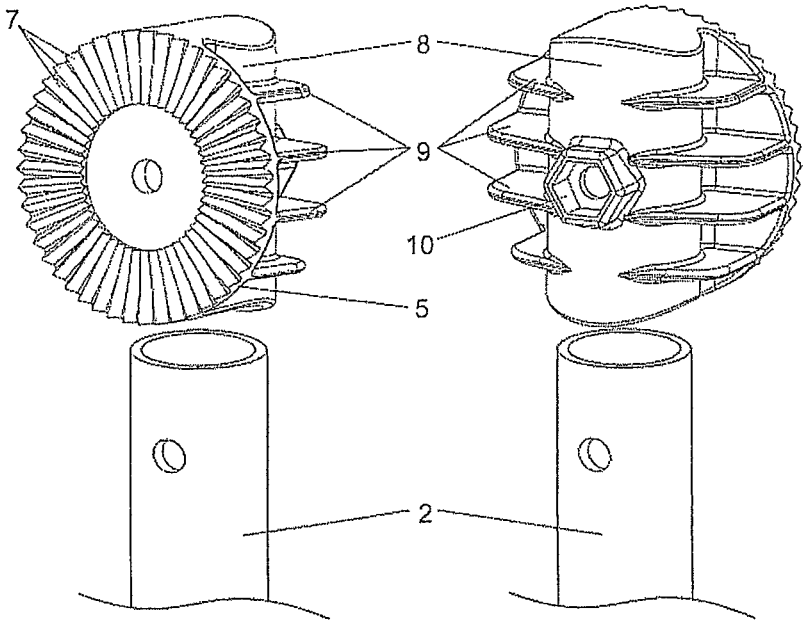
FIG. 5 is an exploded perspective view of the one indexing disc and integrally formed moulded socket from one side thereof.
FIG. 6 is an exploded perspective view of the indexing disc and integrally formed moulded socket from the other side thereof.
Figure 7:
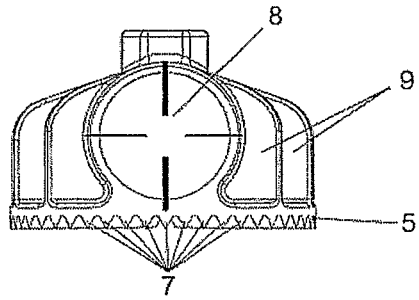
FIG. 7 is a view of the indexing disc and integrally formed moulded socket taken along the axis of the socket.

The indexing disc (5) associated with the staff is formed integral with a plastics injection moulded socket (8) that receives the operatively upper end of the staff (2). The indexing disc is located to one side of the socket and is held in a flat condition by a series of integral flanges (9). On the opposite side of the socket is an integral cavity (10) shaped to receive a conventional hexagonal nut (11) co-axially with the indexing disc. This arrangement is shown most clearly in FIGS. 5 to 7.

Figure 4:
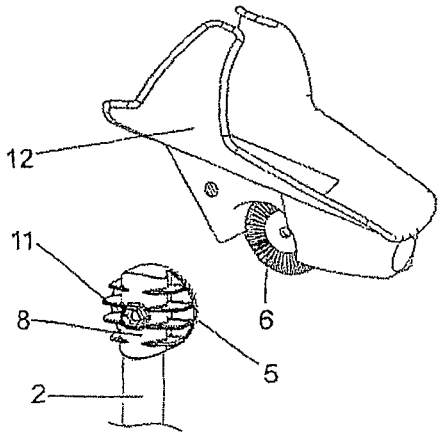
FIG. 4 is an exploded perspective view of the central body of the forearm support from the other side thereof.

The indexing disc (6) associated with the forearm support assembly is formed integral with a central body part (12) of the forearm support assembly as shown clearly in FIG. 4. On a parallel surface opposite the indexing disc (6) is a flat circular recess (13) that accommodates, in use, a clamping disc (14) forming part of a manually rotatable head for rotating an axially extending screw threaded shank (15) held non-rotatably relative to the clamping disc. The clamping disc, shank and nut thus constitute the clamping means mentioned above.

It will thus be understood that the tooth formations (7) may be inter-engaged in a selected one of multiple relative angular positions of the forearm support assembly relative to the staff to provide a desired angle of inclination of the forearm support assembly. The clamping means may be engaged to firmly hold the indexing discs in a selected inter-engaged position for use. It will be substantially impossible for any play to be present in the resultant joint as a result of the shaping of the tooth formations and the fact that they are held firmly clamped in a fully inter-engaged condition in which any angular movement is impossible.

The forearm support assembly has a transverse handle (16) at one end thereof with the handle being carried by a forwardly projecting tubular extension member (17) that terminates at its forward end in the transverse handle. The arrangement is such that the distance between the central body and the handle is adjustable. At the same time the angle at which the handle extends from the axis of the tubular extension member relative to the central body is also adjustable thereby further enhancing the ability of the crutch to be customized.

At the other end of the body part of the forearm support is an angularly hingedly adjustable stabilizer (18) for engaging the upper arm in the region above the elbow.

The surface of the forearm support, in the area thereof that is operatively engaged by the forearm of a user, is provided with a friction affording resilient lining (19) that is particularly adapted to deform to the shape of a user's forearm. The purpose of this is to disperse the force on the forearm and accept some of the weight of the person by way of frictional forces between the forearm and the lining on the forearm support.

It is to be noted that, in order to limit fatigue to the user, and also to limit any tendency of the foot to slip on the surface it engages, the axis of the staff is generally arranged to pass through a point on the forearm support assembly that is approximately 25 percent of the distance between the elbow position and handle in front of the elbow position. It has been that such a position operates particularly well.

It will be appreciated that, in use, the forearm support assembly will provide support to a user in a number of different positions including the hand, elbow and forearm in between these two. The fact that the angle at which the forearm support extends can be accurately adjusted relative to the staff according to individual requirements, and the fact that the staff itself is adjustable in length, enables a substantial amount of customization to be achieved with the result that use of the forearm crutch will be appreciably facilitated and rendered less tiring than in the case of prior art similar crutches. The ground engaging foot, at the same time, provides a shock absorbing effect that further enhances the performance of the crutch.

It will be understood that numerous variations may be made to the embodiment of the invention described above without departing from the scope hereof.

In FIGS. 8 to 10, 12 and 13, a second embodiment of the crutch 1 of FIGS. 1 to 7 is shown having a different adjustment mechanism 21.

The adjustment mechanism 21 allows the angle of inclination of the forearm support assembly to the staff 2 to be adjustable by means of a pair of co-operating positioning portions, which in this embodiment are indexing disks, one round disk 23 being stationary relative to the staff 2 and the other over recessed disk 24 being stationary relative to the forearm support, the disk 23 being receivable within the recess of disk 24. Again, in this embodiment, each indexing disc has multiple equally angularly spaced co-operating formations.

In order to allow for lateral as well as angular adjustment of the position of the staff 2 relative to the forearm support assembly, the pair 23, 24 of indexing disks is provided with a first elongate slot 25 and pin 26 arrangement and a second slot 27 and pin 28, whereby the disks 23, 24 are slidably displaceable relative to each other within the restraints posed by the pins in the slots. The slot 27 extends substantially radially and terminates proximal the periphery of the disk 24 while the slot 25 extends substantially laterally in a central portion of disk 24.

The slots 25, 27 are sized and dimensioned complementarily to the size and dimension of the pins 26, 28 thereby to snugly receive the pins in the slots.

In FIG. 12, in the adjustment mechanism 21 the angularly spaced co-operating formations are a gear teeth 29 located on an outer periphery of one of the indexing portions 23 and complementary gear teeth 30 on an inner peripheral portion of the other indexing portion 24, wherein the indexing portion 23 with gear teeth on its outer periphery is sized and dimensioned to fit snugly within a recess 31 of the indexing portion with gear teeth on an inner peripheral portion 24 whereby the gears mesh to hold the indexing disks 23, 24 in a selected inter-engaged position for use.

In FIGS. 8 to 12, the forearm support has a transverse handle 32 at one end thereof with the support extending operatively rearwards to an elbow supporting zone at its opposite end.

The transverse handle 32 is like a joystick of a gaming apparatus which is anatomically sized and dimensioned for a comfortable and stable grip by a user. The distance of the handle 32 from the elbow supporting zone may be adjustable by means of a spring pressed detent system 33, or a similar system.

The foot 34 may be bendable in a mid-zone 35 thereof so that a ground engaging portion of the foot remains in contact with the surface on which it is used even if the incident angle of the staff to the surface is acute. This foot design can be applied to any embodiment of any crutch, even those known in the art.

The invention claimed is:

1. A forearm type of crutch comprising a staff, a ground engaging foot at an operatively lower end of the staff, a forearm support assembly at an operatively upper end of the staff, and a transverse handle, wherein an inclination angle of the forearm support assembly relative to the staff is adjustable by a first indexing portion and a second indexing portion that cooperate with one another, the first indexing portion being stationary relative to the staff and the second indexing portion being stationary relative to the forearm support assembly and wherein the first and second indexing portions have complementarily co-operating zones that are engagable in different angular positions, and a releasable clamping mechanism that clamps the indexing portions in a selected engaged position for use, wherein one of the first and second indexing portions defines a recess for receiving the other of the first and second indexing portion therein, the recess being oversized relative to the other of the first and second indexing portion so as to permit rotation and relative slideable displacement of the indexing portions, the indexing portions being secured against relative rotation and displacement by the releasable clamping mechanism, such that the forearm support assembly is rotatable and displaceable relative to the operatively upper end of the staff when the clamping mechanism is released.

2. A forearm type crutch as claimed in claim 1, wherein at least the complementarily cooperating zones are made of a frictionally engaging material.

3. A forearm type crutch as claimed in claim 2, wherein one of the first and second indexing portions is stationary relative to the operatively upper end of the staff and the other of the first and second indexing portions is stationary relative to the forearm support assembly and wherein the complementarily co-operating zones include multiple angularly spaced co-operating formations that are engagable in multiple different angular positions of the forearm support assembly and the operatively upper end of the staff to provide a selection from multiple different angles of inclination of the forearm support assembly relative to the operatively upper end of the staff and wherein the releasable clamping mechanism operatively holds the first and second indexing portions in a selected inter-engaged position for use.

4. A forearm type crutch as claimed in claim 3, wherein the angularly spaced co-operating formations are gear teeth located on an outer periphery of one of the indexing portions and complementary gear teeth on an inner peripheral portion of the other indexing portion, wherein the indexing portion with gear teeth on its outer periphery is sized and dimensioned to fit snugly within the recess of the indexing portion with gear teeth on an inner peripheral portion whereby the gears mesh to hold the first and second indexing portions in the selected inter-engaged position for use.

5. A forearm type crutch as claimed in claim 4, wherein the multiple angularly spaced formations are angularly spaced formations on the face of each of the first and second indexing portions.

6. A forearm type crutch as claimed in claim 5, wherein the angularly spaced formations on each of the first and second indexing portions is in the form of a series of said formations extending around an arc of 360 degrees.

7. A forearm type crutch as claimed in claim 6, wherein the formations are in the form of radially extending tooth formations.

8. A forearm type crutch as claimed in claim 7, wherein the formations are of triangular shape in cross-section with the width of the base of the triangle increasing from a radially inner end of a tooth to a radially outer end thereof.

9. A forearm type crutch as claimed in claim 8, wherein the first and second indexing portion associated with the operatively upper end of the staff is formed integral with a plastics injection moulded socket receiving the operatively upper end of the staff.

10. A forearm type crutch as claimed in claim 8, wherein the indexing portion associated with the forearm support assembly is formed integral with a central body part of the forearm support assembly.

11. A forearm type crutch as claimed in claim 1, wherein the releasable clamping mechanism is a screw threaded fastener comprising a nut held non-rotatably relative to one of the first and second indexing portions and a screw threaded shank held non-rotatably relative to a manually operable head for rotating the screw threaded shank.

12. A forearm type crutch as claimed in claim 11, wherein the indexing portions are round or oval.

13. A forearm type crutch as claimed in claim 1, wherein in order to allow for lateral as well as angular adjustment of the position of the operatively upper end of the staff relative to the forearm support assembly, the first and second indexing portions is provided with an elongate slot and pin arrangement, whereby the first and second indexing portions are slidably displaceable relative to each other within the restraints posed by the pin in the slot.

14. A forearm type crutch as claimed in claim 13, wherein the first and second indexing portions is provided with a second elongate slot and pin arrangement to further restrain the relative displacement of the first and second indexing portions.

15. A forearm type crutch as claimed in claim 1, wherein one of the first and second indexing portions is a circular disk and the other is an oval recess in which the circular disk is displaceable and lockable in a desired position within the recess.

16. A forearm type crutch as claimed in claim 15, wherein a stop mechanism is provided to limit the extent of relative displacement, either angularly or laterally, of the indexing portions.

17. A forearm type crutch as claimed in claim 1, wherein the transverse handle is located at one end of the forearm support assembly and the forearm support assembly extends operatively rearwards to an elbow supporting zone at its opposite end.

18. A forearm type crutch as claimed in claim 17, wherein the transverse handle is anatomically sized and dimensioned for a comfortable and stable grip by a user.

19. A forearm type crutch as claimed in claim 17, wherein an orientation of the transverse handle is adjustable relative to the forearm support assembly.

20. A forearm type crutch as claimed in claim 17, wherein a distance of the handle from the elbow supporting zone is adjustable.

21. A forearm type crutch as claimed in claim 17, wherein an opposite end of the forearm support assembly has an angularly adjustable stabilizer for, in use, engaging the upper arm of a user in the region above the elbow of the user.

22. A forearm type crutch as claimed in claim 1, wherein the foot is a resiliently deformable foot exhibiting shock absorbing characteristics.

23. A forearm type crutch as claimed in claim 22, wherein the foot is bendable in a mid-zone thereof so that a ground engaging portion of the foot remains in contact with the surface on which it is used even if the incident angle of the staff to the surface is acute.

24. A forearm type crutch as claimed in claim 1, wherein at least a portion of a surface of the forearm support assembly is provided with friction affording padding or lining.

* * * * *